US005806651A

United States Patent [19]

Carmen et al.

[11] Patent Number: 5,806,651

[45] Date of Patent: Sep. 15, 1998

[54] COIN DISCRIMINATION SYSTEM

[75] Inventors: Ralph H. Carmen, Merritt Island, Fla.; Joseph H. Sutton; Daniel P. Kasuba, both of Harrison, Ak.

[73] Assignee: Duncan Industries Parking Control Systems Corp., Harrison, Ak.

[21] Appl. No.: 770,180

[22] Filed: Dec. 19, 1996

[51] Int. Cl.[6] ..... G07D 5/08

[52] U.S. Cl. ..... 194/319

[58] Field of Search ..... 194/317, 318, 194/319

[56] References Cited

U.S. PATENT DOCUMENTS

| | | | |
|---|---|---|---|
| 4,705,154 | 11/1987 | Masho et al. | 194/319 |
| 4,754,862 | 7/1988 | Rawicz-Szczerbo et al. | 194/319 |
| 5,180,046 | 1/1993 | Hutton et al. | 194/319 |
| 5,244,070 | 9/1993 | Carmen et al. | 194/319 |
| 5,353,906 | 10/1994 | Takami et al. | 194/319 |

*Primary Examiner*—F. J. Bartuska
*Attorney, Agent, or Firm*—Rudnick & Wolfe

[57] ABSTRACT

A coin-sensing system wherein at least two sensor coils are electrically connected in series and physically arranged so that a coin deposited into the apparatus may pass sequentially through each sensor coil and thereby change the impedance of the coil. A sensor oscillator circuit incorporates the sensor coils to output an oscillating sensor signal at a frequency dependent on the impedance of the sensor coils. Counters measure the frequency of the sensor signal to obtain a frequency signature for the deposited coin which can be compared with frequency signatures of valid coins. The oscillator circuit may produce a lower frequency oscillating sensor signal or a higher frequency oscillating sensor signal and electronic switches are included in the circuit for switching from one of the frequency levels to the other after the deposited coin encounters a first sensor coil and before the deposited coin encounters a second sensor coil.

9 Claims, 4 Drawing Sheets

COIN DISCRIMINATION SYSTEM

BACKGROUND OF THE INVENTION

The present invention relates to methods and devices for sensing the presence and characteristics of coins and other types of tokens (hereinafter "coins") as part of, for example, a coin-operated parking meter. Primary objectives of such devices are to discriminate between valid coins and counterfeit ones or other coin-like objects, as well as between different denominations of valid coins.

A common coin sensing method employed by previous devices is the use of a sensor coil whose impedance is changed by the nearby presence of a metal object such as a coin. One type of discrimination circuit using such a sensor coil is a bridge circuit which includes standard impedance elements in addition to the coil. Passage of the coin near the coil then causes the balance point to change.

Another type of detection circuit uses the coil as part of an oscillator circuit. The presence of a coin near the coil causes the frequency at which the oscillator resonates to shift. By measuring the frequency shift, it is possible to detect the presence of a coin. Furthermore, the magnitude of the frequency shift will depend on such things as the size and material content (e.g., iron, copper, or silver etc.) of the coin. Therefore, standard frequency shift "signatures" for valid coins can be ascertained allowing the circuitry to discriminate between denominations of valid coins and between valid coins and other objects.

A problem with sensor coils of the type described above, however, is that the changes in impedance or frequency shift are dependent upon both the total metal mass of the coin and the particular material out of which the coin is made. This means the same impedance change, for example, can be caused by either a large, low response material (e.g., copper) coin or a small, high response material (e.g., iron) coin.

Such previous sensor coils may also require a large amount of power in order to properly discriminate between coins. This can be a particular problem in applications where the coin sensing device does not have access to an external power source such as is the case with parking meters.

Carmen et al U.S. Pat. No. 5,244,070 discloses a coin sensor which employs sensor coils electrically connected in series and as part of an oscillator circuit. The coils are physically positioned so that a coin to be detected passes sequentially through the two coils. The coils are spaced apart at approximately the diameter of the largest coin accepted as valid by the sensor (e.g., about 0.96 inches for a U.S. quarter). A coin passing through the first coil changes the impedance of the coil so that the frequency of the oscillator output increases. The resulting frequency shift will be maximum when the coin is at the center of the coil. As the coin exits the first coil and enters the region between the two coils, the oscillator frequency decreases and then increases again as the coin passes through the second coil. Thus, the coin passage produces two peaks of maximum frequency shift separated by a local minimum.

The frequency at the local minimum will be very near the steady state value for a small coin since the coin will have a very small effect on either coil when in the region between the two coils. A larger coin with the same material content, on the other hand, will still affect both coils to some extent so that the oscillator frequency at the local minimum will be greater than in the case of a small coin. The patented invention therefore allows discrimination between large, low response material coins and small, high response material coins. Also, since the coin passes through the coils where the magnetic field is strongest, more sensitivity is obtained for a given amount of power.

SUMMARY OF THE INVENTION

This invention relates to improvements in the aforementioned Carmen et al patented invention. The improvements achieve significantly increased performance particularly with reference to distinguishing between valid and invalid "high response" coins. For example, some coins of Mexico and other countries are difficult to distinguish from steel washers and this invention, among other advantages, effectively addresses that problem.

One aspect of the invention involves the addition of electronic switch means, such as a pair of switched capacitors, to the coin oscillator network. The prior embodiment of the dual coil detector observed the frequency of the coil oscillator as a coin descends through the pair of coils. This frequency increases as the coin enters the top coil, reaches a maximum, decreases to a local minimum with the coin positioned between the coils, and then rises to a second maximum with the coin positioned in the second coil. The value of the second maximum could be predicted based on the first maximum since the frequency deviation produced by a coin is approximately the same for each coil.

This invention involves switching the pair of capacitors at some point between the time the first and second maximums are observed which modifies the coil oscillator frequency dramatically and, for certain coins, obtains a second maximum which is relatively independent of the first maximum and minimum. This independent measurement is particularly useful for discriminating between "high response" coins, such as those of Mexico, and steel washers.

Another aspect of the invention involves use of a faster oscillator amplifier. This reduces sensitivity to amplifier performance since lower amplifier circuit transit delay makes the total network delay more dependent on external components such as the dual coil and associated capacitors, the values of which are fixed. In addition, a thermistor and resistor have been added in series with the dual coil detector to directly compensate for changes in the dual coil copper wire due to temperature variations.

BRIEF DESCRIPTION OF THE INVENTION

Figure 1:
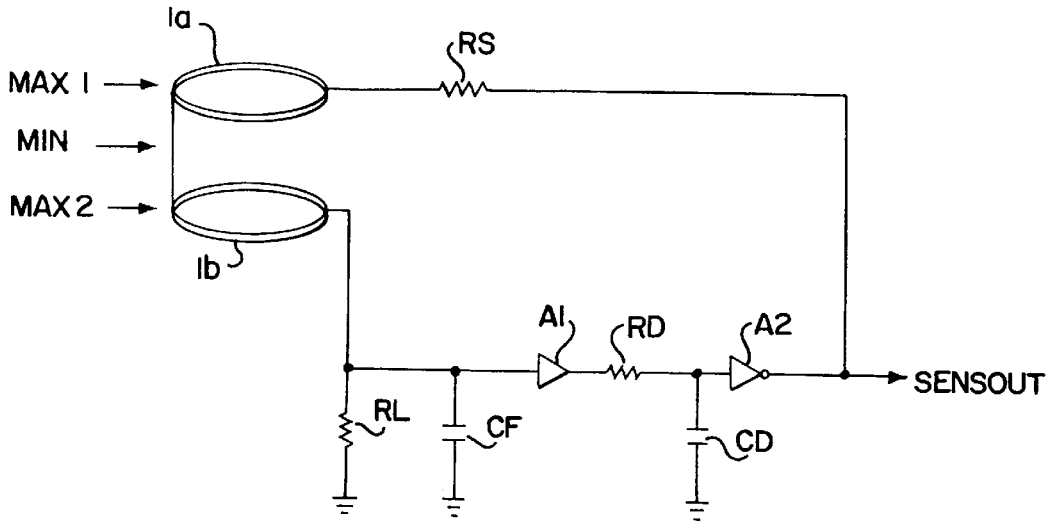
FIG. 1 is a schematic of an oscillator circuit showing the arrangement of the dual sensor coils in accordance with the invention disclosed in U.S. Pat. No. 5,244,070.

FIG. 1 is a schematic taken from the disclosure of U.S. Pat. No. 5,244,070 which illustrates the physical arrangement of two sensor coils 1*a* and 1*b* and their incorporation into an exemplary oscillator circuit. The coils 1*a–b* are designed to be placed in a coin's path so that the coin will pass sequentially through each coil. A typical coin-operated meter will have the two coils 1*a–b* mounted within a coin chute so that an inserted coin will fall through both coils. In order for the monitoring circuitry described below to know when a coin is about to enter the sensor coils, some type of coin detector is placed in the coin path just in front of the sensor coils. This provides a coin detect signal CNDTCT (See FIG. 3) for use by the monitoring circuitry.

The oscillator circuitry shown in FIG. 1 comprises the sensor coils 1*a–b*, capacitor CF, capacitor CD, resistor RD, high gain non-inverting amplifier A1, and high gain inverting amplifier A2. Resistors RS and RL are included in FIG. 1 to represent series losses in the coil and losses due to a coin or metal object, respectively.

The sensor coils are electrically connected in series so as to provide a feedback path around the cascaded amplifiers A1 and A2. Because amplifier A2 is inverting, the signal fed back through the sensor coils is phase shifted 180°. Alternative embodiments may employ any number of cascaded amplifiers as long as there is an odd number of inversions to provide the 180° phase shift. The result is an oscillator circuit which oscillates at a certain resonant frequency depending on the values of L and CF, where L is the total inductance of the sensor coils. The resistor RD and capacitor CD are included to stabilize the amplifier delay over the intended operating temperature range. It has been found that temperature stability is also enhanced by potting the coils 1*a–b* with a suitable (and preferably low loss, e.g., non-carbon based) potting compound. Using temperature stable capacitors and a very temperature stable resistor (RD) also enhances stability over the operating temperature range.

As explained in greater detail in U.S. Pat. No. 5,244,070, the resistor labeled RL is intended to represent losses introduced to the coil sensor by insertion of a coin into the coil core. Those losses generally result from eddy currents induced in the coin. With no coin in the coil, the value of RL is effectively infinite (no losses) and the effective value of RL decreases with the insertion of ever more lossy coins into the coil core. The decrease in the effective value of RL causes an increase in sensor operating frequency.

Figure 2:
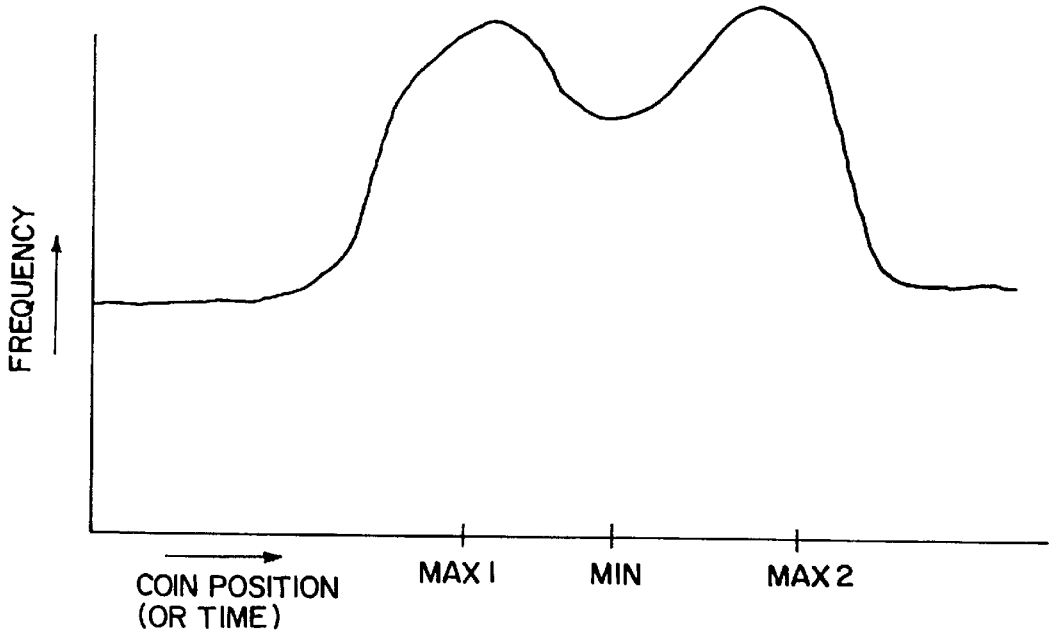
FIG. 2 shows an exemplary frequency signature achieved using the prior invention.

As a coin enters the sensor, eddy current losses reduce the effective value of RL and cause an increase in the sensor operating frequency which is observed at the sensor output SENSOUT. A coin descending through the sensor coils will cause the frequency of SENSOUT to increase to a maximum when the coin is within coil 1*a*, decrease to a local minimum when the coin is between the coils, and increase to a maximum again as the coin passes through coil 1*b*. These positions are indicated in FIG. 2 by the labels MAX 1, MIN, and MAX 2, respectively. Thus, by measuring the frequency of SENSOUT as the coin passes through the sensor coils, frequency values for the positions MAX 1, MIN, and MAX 2 may be ascertained. These three frequency values constitute a signature which may then be compared with standard values stored in a table to determine if the coin is valid and, if so, its denomination. FIG. 2 shows an exemplary signature where oscillator frequency is plotted versus coin position (equivalent to time).

The monitoring circuitry described in U.S. Pat. No. 5,244,070 (FIG. 3) basically comprises two counters, a coil counter and a reference counter. The reference counter is driven by a crystal oscillator 25 at a fixed frequency while the coil counter is driven by the SENSOUT signal from the sensor oscillator (FIG. 1). After initializing the two counters, the operation of each is triggered by the SENSOUT signal. After the coil counter has reached a predetermined value, the reference counter is stopped and its contents read. The reference counter contents are then inversely proportional to the frequency of SENSOUT. By taking sequential readings in this manner after being triggered by a signal from the optical coin detector, two frequency maximums and a local frequency minimum of SENSOUT may be obtained which correspond to the coin being at the positions labeled MAX 1, MIN, and MAX 2 in FIG. 2. The resulting signature comprising the three frequency values may then be compared with previously stored signatures corresponding to valid coins to determine the validity and denomination of the coin.

Figure 3:
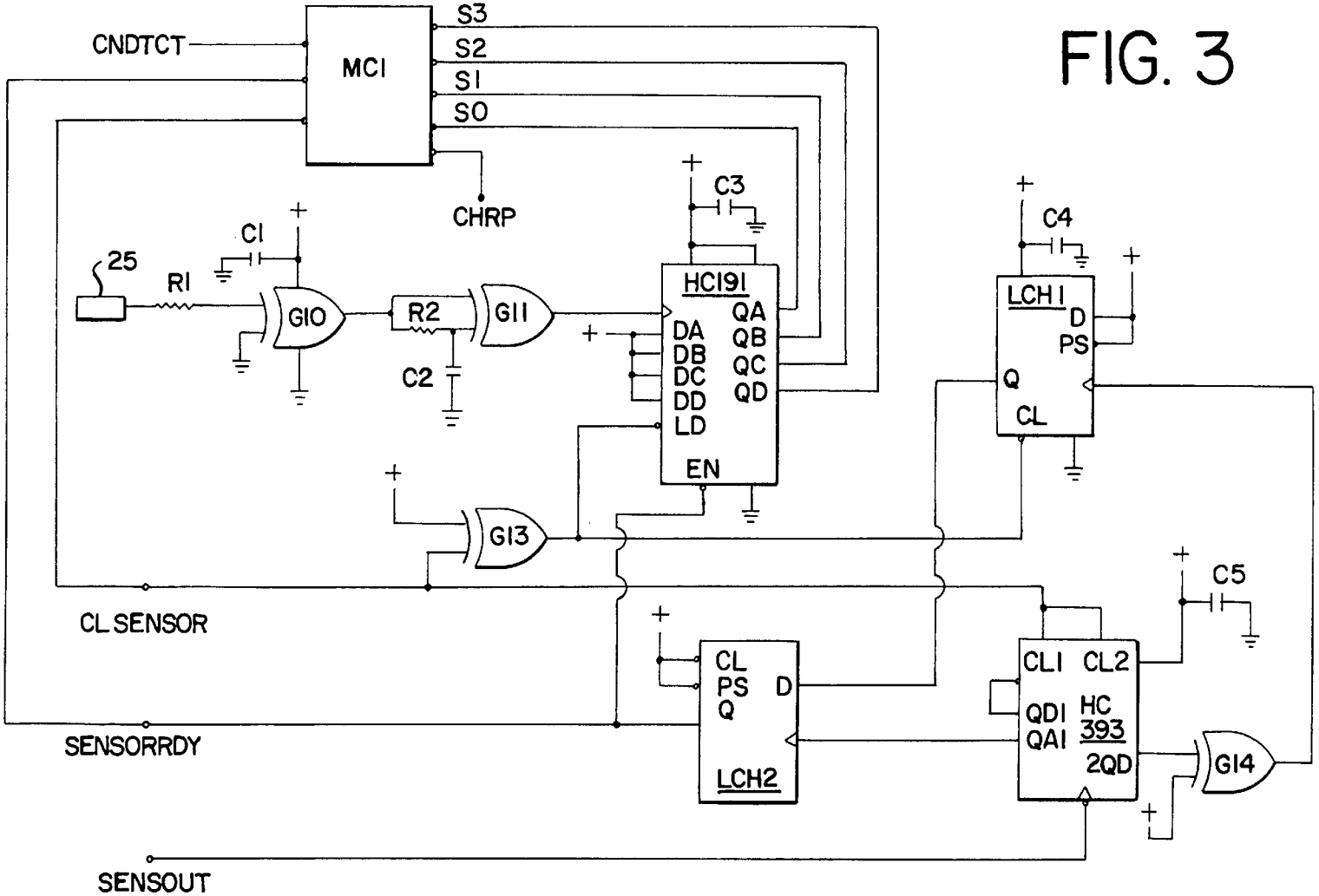
FIG. 3 is an electronic schematic showing the monitoring circuitry for tracking the frequency of the oscillator circuit in the prior invention.
Figure 4:
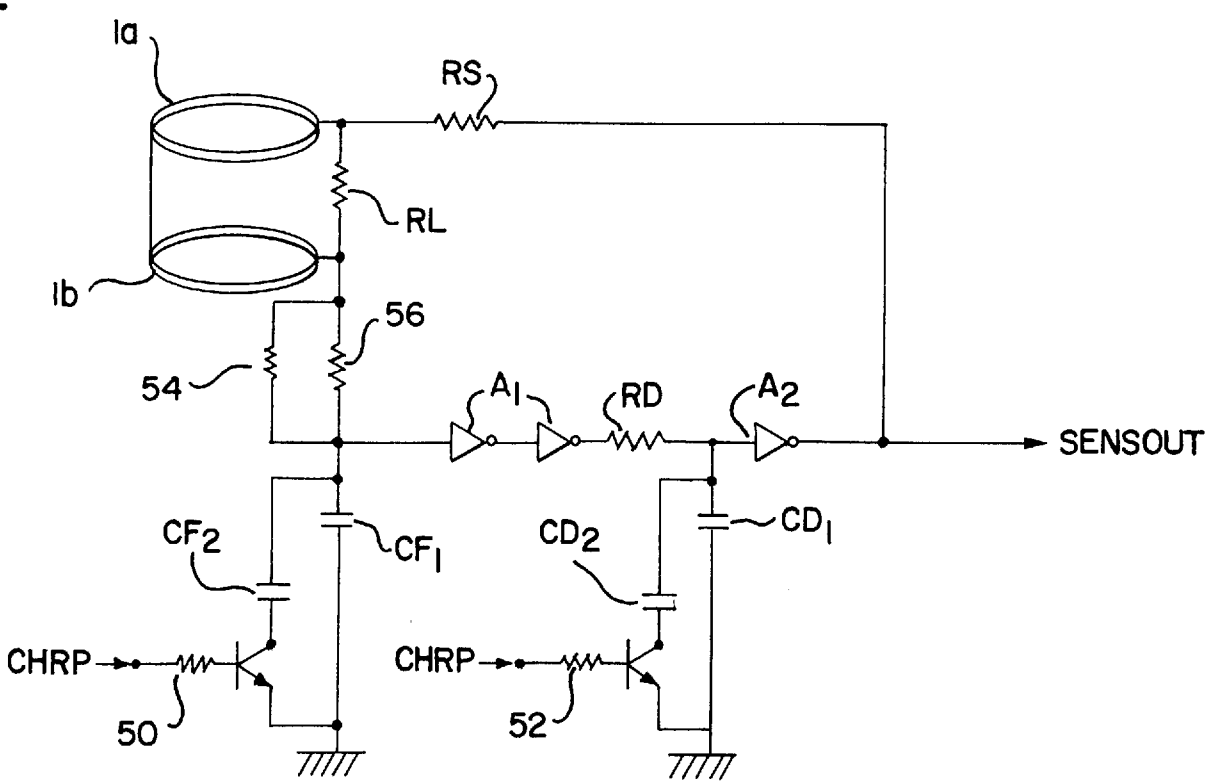
FIG. 4 is an electronic schematic showing a circuit employed for achieving the improvement of this invention; and, FIG. 5 shows an exemplary frequency signature obtained when using the circuit shown in FIG. 4.
Figure 5:
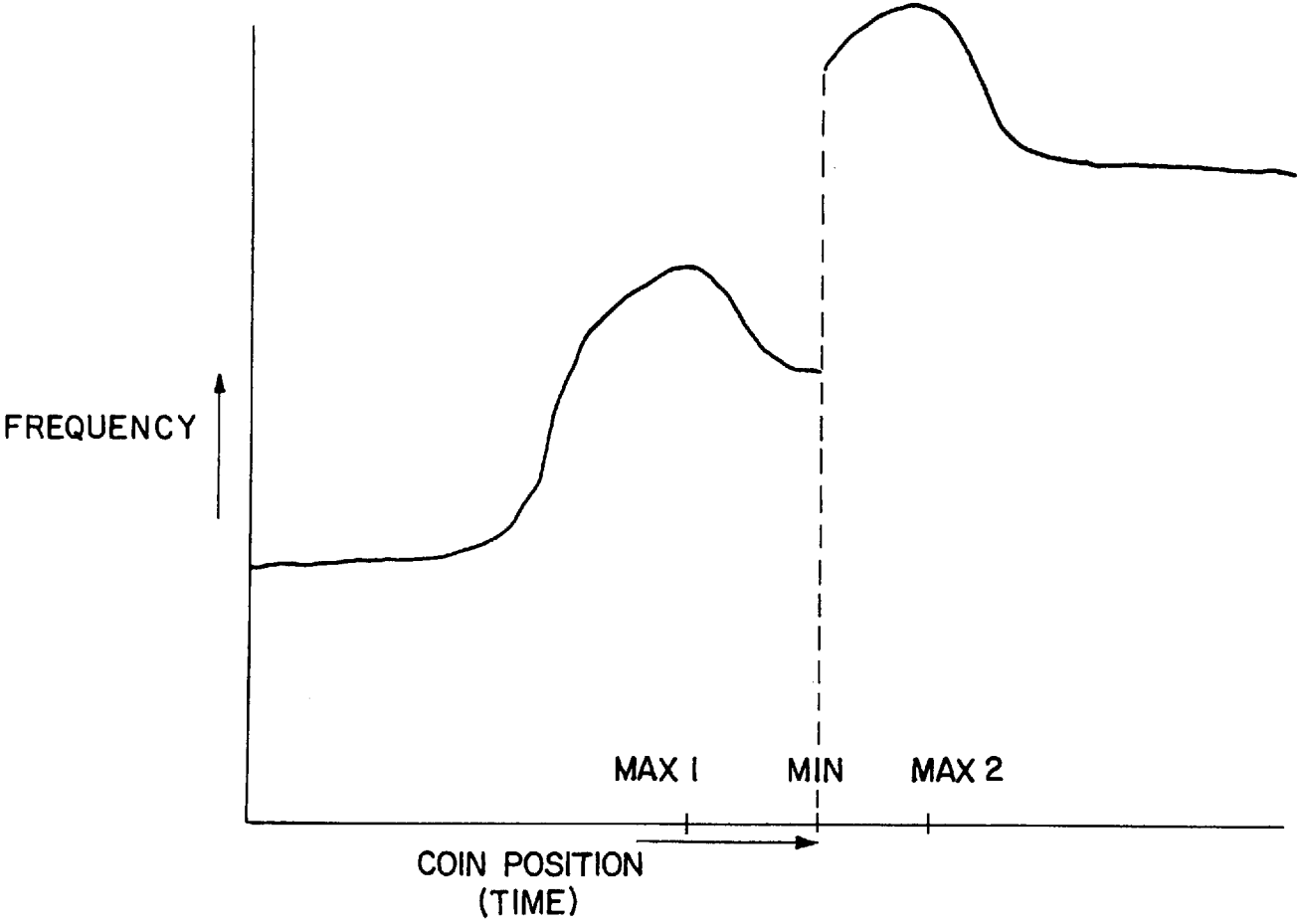

FIG. 4 illustrates an example of an improved oscillator circuit employed for controlling a coil counter of the type shown in FIG. 3. Symbols corresponding to those used in FIG. 1 are used in FIG. 4 where applicable. FIG. 5 illustrates a coin signature achieved with the oscillator circuit of FIG. 4.

The circuit of FIG. 4 also includes coils 1*a*–1*b* and resistors RS and RL representing series losses and losses due to a coin, respectively. A feedback path is provided around cascaded amplifiers $A_1$ and $A_2$, the former comprising a pair of inverting amplifiers in this instance. The frequency of SENSOUT will vary as a coin descends in the manner described with reference to FIG. 1.

Also included in the circuit of FIG. 4 are switched capacitors which are used to augment the value of the capacitors CF and CD of FIG. 1. Specifically, capacitor $CF_1$ is connected in parallel with capacitor $CF_2$ and transistor 50. $CF_2$ is, therefore, switched on or off depending on the state of transistor 50. Similarly, capacitor $CD_1$ is connected in parallel with capacitor $CD_2$ and transistor 52, and $CD_2$ can be switched on and off.

In one example of the practice of the invention, components of the following specifications are used:

| | |
|---|---|
| $CF_1$ | .0022 NPO |
| $CF_2$ | .015 NPO |
| $CD_1$ | 220 NPO |
| $CD_2$ | .0018 NPO |
| Transistors 50, 52 | 2N4401; 2.2K resistors |

With this arrangement, dramatically different coil oscillator frequencies are achieved depending upon the state of the switched capacitors. Specifically, with the capacitors switched in initially, a low frequency measurement is achieved. Thus, as shown in FIG. 5, a coin passing by coil 1*a* will cause a frequency change to a first maximum, MAX 1, which is followed by a declining frequency as the coin descends to a position of less influence on coil 1*a*.

Microprocessor MC1, FIG. 3, is programmed to detect the frequency changes and to send a signal, CHRP, at some point after MAX 1 is achieved. In the illustrated embodiment, the signal is sent when frequency MIN is reached and at the moment that an increase in frequency is detected.

The CHRP signal is sent to transistors 50, 52 which switches the capacitors $CF_2$ and $CD_2$ off. This results in high frequency measurement of the second maximum, MAX 2, as shown in FIG. 5. The use of these different levels of frequency measurement is of great significance when, for example, distinguishing between "high response" coins (Mexican coins vs. steel washers).

Variations from the specific example of the invention which has been given are achievable. Thus, other electronic switch means could be used, for example, of the thyristor or field effect type. In addition, signature measurement sequence could be reversed so that a high frequency measurement would be followed by a low frequency measurement.

Another possible variation would be to use a third coil and even a fourth coil for a distinctly different frequency measurement. Thus, the system shown in FIG. 1 could be used to achieve a signature as shown in FIG. 2 followed by switching to a different frequency measurement using one or more additional coils. Such variations will always be accompanied by standard frequency signatures located in memory for comparison with the signatures measured.

The circuit of FIG. 4 may be employed using a faster oscillator amplifier, AC04 vs. HC04, to reduce sensitivity to amplifier performance. In addition, and as shown in FIG. 4, thermistor 54 and parallel resistor 56 may be added in series to directly compensate for variation in the dual coil copper wire resistance. In particular, variations in performance due to temperature changes can be minimized or eliminated with this arrangement.

It will be understood that various other changes and modifications may be made in the system described without departing from the spirit of the invention particularly as described in the following claims.

That which is claimed:

1. A coin-sensing apparatus wherein at least two sensor coils are electrically connected in series and physically arranged so that a coin deposited into the apparatus may pass sequentially through each sensor coil and thereby change the impedance of the coil, a sensor oscillator circuit incorporating the sensor coils to output an oscillating sensor signal at a frequency dependent on the impedance of the sensor coils, and including counter means for measuring the frequency of the sensor signal to obtain a frequency signature for the deposited coin which can be compared with frequency signatures of valid coins, the improvement comprising first means in said circuit for outputting a lower frequency oscillating sensor signal, and second means in said circuit for outputting a higher frequency oscillating sensor signal, switch means in said circuit and means for operating said switch means for switching from one of said first and second means to the other of said first and second means after the deposited coin encounters a first sensor coil and before the deposited coin encounters a second sensor coil.

2. The coin-sensing apparatus as set forth in claim 1 wherein the signature for the deposited coin comprises a first frequency maximum when the coin encounters the first sensor coil, a local frequency minimum when the coin is between coils, and a second frequency maximum when the coin encounters the second sensor coil, said means for operating said switch means being adapted to operate after said first frequency maximum is reached and before said second frequency maximum is reached.

3. The coin-sensing apparatus as set forth in claim 2 wherein said switch means comprise transistors, capacitors associated with the transistors for controlling the frequency, and means for delivering signals to the transistors after said first frequency maximum is reached to switch the capacitors between an active state and an inactive state.

4. The coin-sensing apparatus as set forth in claim 1 wherein the sensor coils are spaced apart at approximately the diameter of the largest valid coin to be accepted.

5. The coin-sensing apparatus as set forth in claim 3 comprising a programmed computer for comparing the frequency signatures, said computer being programmed to deliver said signals to said transistors.

6. The coin-sensing apparatus as set forth in claim 1 comprising a parking meter.

7. A method for sensing coins to discriminate between valid and invalid coins wherein at least two sensor coils are electrically connected in series, arranging the coils so that a coin passes sequentially through each sensor coil and thereby changes the impedance of the respective coils, providing a sensor oscillator circuit incorporating the sensor coils for outputting an oscillating sensor signal at a frequency dependent on the impedance of the sensor coils, counting the frequency of the sensor signal to obtain a frequency signature for the coin, comparing that frequency signature with frequency signatures of valid coins, providing a first means in said circuit for outputting a lower frequency oscillating sensor signal, providing a second means in said circuit for outputting a higher frequency oscillating sensor signal, and switching from one of said first and second means to the other of said first and second means after the deposited coin encounters a first sensor coil and before the deposited coin encounters a second sensor coil whereby the signature measurements of the respective coils are taken at different frequencies.

8. A method according to claim 7 wherein the signature measurement comprises a first frequency maximum when the coin encounters said first sensor coil, a local frequency minimum when the coin is between coils, and a second frequency maximum when the coin encounters said second sensor coil, and conducting said switching after said first frequency maximum is reached and before said second frequency maximum is reached.

9. A method according to claim 8 including the step of conducting said switching at approximately the time the local frequency minimum is reached.

* * * * *